United States Patent [19]

Bukowski et al.

[11] Patent Number: 4,577,281

[45] Date of Patent: Mar. 18, 1986

[54] METHOD AND APPARATUS FOR CONTROLLING THE CONTROL VALVE SETPOINT MODE SELECTION FOR AN EXTRACTION STEAM TURBINE

[75] Inventors: James M. Bukowski; Gary E. Midock, both of Pittsburgh; Ronald J. Walko, Bethel, all of Pa.

[73] Assignee: Westinghouse Electric Corp., Pittsburgh, Pa.

[21] Appl. No.: 562,378

[22] Filed: Dec. 16, 1983

[51] Int. Cl.[4] ..... F01D 17/02

[52] U.S. Cl. ..... 364/494; 60/660

[58] Field of Search ..... 364/14, 492, 493, 494, 364/464, 174, 176; 60/648, 660, 662; 290/40 R, 40 A, 40 C; 415/15, 17

[56] References Cited

U.S. PATENT DOCUMENTS 4,057,715 11/1977 Jones et al. ..... 415/15
4,205,380 5/1980 Braytenbah ..... 415/17
4,220,869 9/1980 Uram ..... 364/494
4,245,162 1/1981 Ronnen et al. ..... 60/660
4,471,446 9/1984 Podolsky et al. ..... 364/494

*Primary Examiner*—Parshotam S. Lall
*Attorney, Agent, or Firm*—W. E. Zitelli

[57] ABSTRACT

A microprocessor-based controller for an extraction type steam turbine-generator unit capable of selecting from a variety of predetermined control strategies and implementing corresponding valve position control loops by generating appropriate valve position control signals in accordance with operator-chosen setpoint signals and turbine operating level signals. In a particular control strategy, automatic compensation of megawatt output is achieved during the extraction mode of turbine operation by summing a megawatt setpoint signal from a feedback loop with a feedforward extraction valve setpoint signal and a megawatt reference signal, which sum is then applied to the turbine control valves to enable tight megawatt control during the extraction operation.

15 Claims, 4 Drawing Figures

METHOD AND APPARATUS FOR CONTROLLING THE CONTROL VALVE SETPOINT MODE SELECTION FOR AN EXTRACTION STEAM TURBINE

CROSS-REFERENCE TO RELATED APPLICATIONS

The present application is related to two concurrently filed patent applications bearing Ser. Nos. 562,607, filed Dec. 19, 1983 and 562,508 filed Dec. 19, 1983 by the same inventors, which are assigned to the same assignee as the present application, the disclosures of which are incorporated herein by reference.

BACKGROUND OF THE INVENTION

The invention relates to steam turbine control systems, more particularly to a control system for an extraction type steam turbine.

A common aspect of many industrial environments is the required simultaneous provision of adequate process steam and electric power. Extraction turbines allow a portion of their inlet steam flow to be directed to a process steam header by use of an extraction valve. They are widely used in industrial environments for cogeneration of process steam and electric power requirements because of their ability to accurately match these requirements in a balanced and stable fashion. In any given industrial plant, these requirements vary over time and an extraction turbine control system attempting to provide and match these requirements must respond accordingly.

Industrial utilization of extraction turbines requires appropriate adjustment of front-end extraction turbine control valves and the extraction valve. These adjustments are made through application of well-known valve position control loop technology.

A control loop is established by a combination of signals, including one representing the desired level of turbine operation, and one representing the existing level of turbine operation. A prior art analog controller functions in the control loop to compare these two signals, and noting any discrepancy, it operates to automatically bring the turbine operation to that level required to balance these signals. The particular combination of signal elements in a control loop reflects the control strategy used by the system designer. The combined operation of several control loops achieves the overall control philosophy used in the control system design.

The majority of extraction turbines in service are used in the industrial area—steel mills, refineries, paper mills, sewage treatment plants, etc., where in the past, generation of electricity by the extraction turbine was a byproduct and not really a necessity. The major use of the extraction turbine in these cases was for process steam availability. The extraction process steam is used to feed heaters in the plant, such as auxiliary heaters, furnace heaters and building heaters. It is used to power steam-driven pumps and is also used in various quenching processes associated with steel mill operations, such as coke-quenching and quenching of hot metal strip as it exits the rolling mill.

Prior art extraction turbine control systems have emphasized process steam extraction control at the expense of electric power output or megawatt control, that is, they have achieved tight extraction control while allowing megawatt output to deviate and float to a level consistent with a given process steam extraction requirement. Often, a complex, lengthy and delicate valve readjustment procedure was performed by an operator in a local control mode to bring megawatt output back to a desired level after having deviated due to a previous adjustment in the process steam extraction level via the extraction valve controller. A major difficulty of this readjustment procedure was presented by the requirement that it was performed so as to avoid a process upset, that is, that it was bumpless.

The operator's readjustment procedure was further complicated by the need to readjust settings due to the drift introduced by prior art analog control system circuitry which depended on discrete electronic components such as operational amplifiers, capacitors, diodes and resistors, etc. These circuits were prone to drift out of calibration over time and with temperature variations.

With unceasing increases in the costs of energy, personnel and equipment, the inadequacies of older extraction turbine control strategies have become magnified. The potential for operating cost reductions may be available through the application of industrial energy management systems. These optimization systems are arranged to provide the front-end plant boiler controls with the steam pressure, steam flow, and electrical energy requirements for the entire industrial plant. In order for plant optimization to occur, the boiler controls must be able to transmit to the extraction turbine control system the required level of extraction steam pressure and/or flow and/or megawatt output. Use of the boiler control system as a remote control system to automatically send into the extraction turbine control system all of the various process setpoints requires the provision of an extraction turbine control system capable of responding to them and moving its operational level in a bumpless fashion, without the need for operator intervention. The extraction turbine becomes a more important factor in this case especially in the cogeneration sense where power is being sold and delivered to the utility power grid. Now, tighter control of megawatt output becomes a more important function than it has been in the past.

It can be seen that prior art extraction turbine control systems reflected control strategies which did not fully exploit the extraction turbine capabilities noted earlier. It would therefore be desirable to provide a method for selection, from multiple available control loops, a particular control loop or combination of control loops reflecting a particular control strategy or strategies. It would also be desirable to provide a simplified method of extraction turbine control to fully utilize the capabilities of the extraction turbine in meeting process steam and electrical energy requirements. It would also be desirable to provide an extraction turbine control system that makes more efficient use of the extraction turbine by achieving tight control of extraction steam requirements and tight control of megawatt output through megawatt output correction during a process steam extraction mode. It would also be desirable to provide an extraction turbine control system with control loops that are free from drift in calibration of circuit components, thereby reducing periodic maintenance requirements. It would also be desirable to provide an extraction turbine control system that is capable of accepting remotely generated optimization setpoint signals and adjusting its operational level in accordance therewith, without the need for operator intervention once the operator has chosen a remote mode. Such a control system would enable the realization of front-end boiler fuel cost reductions because of the smoother boiler operation associated with better and more stable extraction turbine control.

SUMMARY OF THE INVENTION

An extraction type steam turbine-generator unit is provided with a microprocessor-based controller for selecting predetermined control strategies and implementing corresponding valve position control loops by generating appropriate valve position control signals in accordance with either remotely generated or operator-chosen setpoint signals and turbine operating level signals. A particular control strategy is disclosed involving automatic compensation of megawatt output during the extraction mode of turbine operation by summing a megawatt setpoint signal from a feedback loop with a feedforward extraction valve setpoint signal and a megawatt reference signal, which sum is then applied to the turbine control valves to enable tight megawatt control during the extraction operation.

DESCRIPTION OF THE PREFERRED EMBODIMENT

Figure 1:
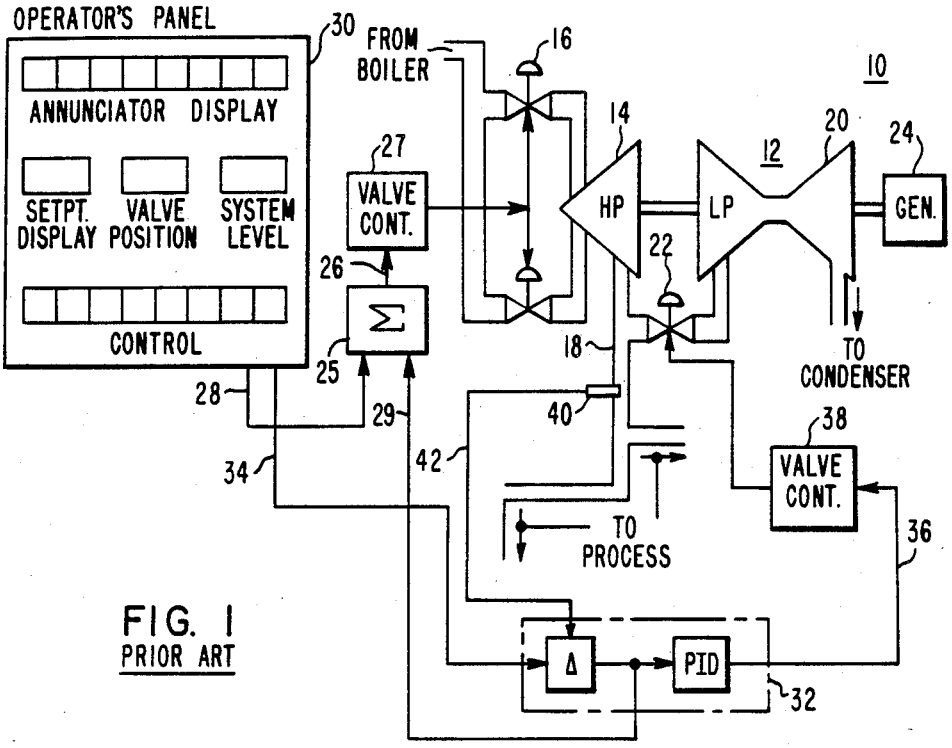
FIG. 1 PRIOR ART
FIG. 1 shows an extraction turbine plant operated by a typical prior art control system.

With reference to FIG. 1, a prior art extraction steam turbine control system 10 is shown in which an extraction turbine 12 is fed with inlet steam at a fixed temperature and pressure from a boiler (not shown) which enters at the high pressure (HP) section 14 of the extractor turbine 12 through a pair of upper and lower control valves 16. The steam drives the HP turbine blades and then exits the seventh stage of the HP section 14 to the industrial process steam header 18 and to the low pressure (LP) section 20 of the extraction turbine 12.

Maximum process steam flow to a plant process where it is to be used corresponds to a minimum opening of the extraction valve 22. However, the extraction valve 22 is kept from fully closing to maintain a flow of cooling steam to the LP section 20 of the extraction turbine 12, which overcomes the heat generated by the friction of the moving LP blades in the dense atmosphere of steam. An electric power generator 24 is coupled to the turbine shaft for production of electric power for use in the plant process, or possibly for sale to the electric utility power grid.

The extraction turbine 12 is started in a conventional manner, and after being loaded, the generator 24 is producing megawatts and the extraction valve 22 is wide open, corresponding to no extraction reference signal 34 in an initial system operating mode. Therefore, the extraction valve error signal 29 is zero in this case and does not contribute in summer 25 to the control valve setpoint signal 26. A valve controller 27, typically an electrohydraulic valve servo and servo driver loop, positions the control valves 16 in an open-loop fashion in accordance with the control valve setpoint signal 26 which is equal to the megawatt reference signal 28 from the operator's panel 30.

The extraction valve setpoint signal controller 32 interfaces with the operator's panel 30 for establishing the level of performance, as represented by the extraction reference signal 34, within the process steam extraction mode of turbine operation. The extraction valve setpoint signal 36 is fed to a valve controller 38 for positioning the extraction valve 22. A steam pressure/flow transducer 40 on the industrial process steam header 18 provides a feedback signal 42 to the extraction valve setpoint signal controller 32 to maintain a stable extraction operation.

As noted earlier, this scheme achieves tight extraction control but does so with negative consequences for megawatt output. The megawatt output existing prior to entry into the extraction operation will now tend to deviate and float to a level consistent with the process steam extraction requirement once this requirement has been established by the extraction valve setpoint signal controller 32. In other words, the inlet steam energy is converted to electrical energy by the turbine only to the extent that the inlet steam is not extracted for other plant use.

An attempt is made to roughly correct megawatt output for a change in the extraction operation. The extraction valve error signal 29 is used as a feedforward signal in summer 25 as to adjust the control valve setpoint signal 26. The feedforward signal does not entirely achieve this because of the lack of megawatt feedback.

The present invention provides a microprocessor-based control system for operating an extraction turbine to satisfy extraction steam and megawatt output demand. The present invention provides two selectable megawatt control loops, one of which can be placed in service when tighter megawatt control is desired as extraction steam demand is met. Each of these two megawatt control loops provides a separate type of contribution to the control valves. With one of these megawatt control loops in service while the extraction turbine is in the full condensing mode, meaning no extraction steam is being taken, the control valve setpoint signal is set at a level such that a megawatt error signal is zero. If the extraction control loop is in service and tighter megawatt control is desired, the second megawatt control loop uses a megawatt setpoint signal as a trim signal in conjunction with the extraction valve setpoint signal and the megawatt reference signal to generate an extraction-corrected control valve setpoint signal so as to compensate for an undesired change in megawatt output resulting from a process steam extraction operation.

Figure 2:
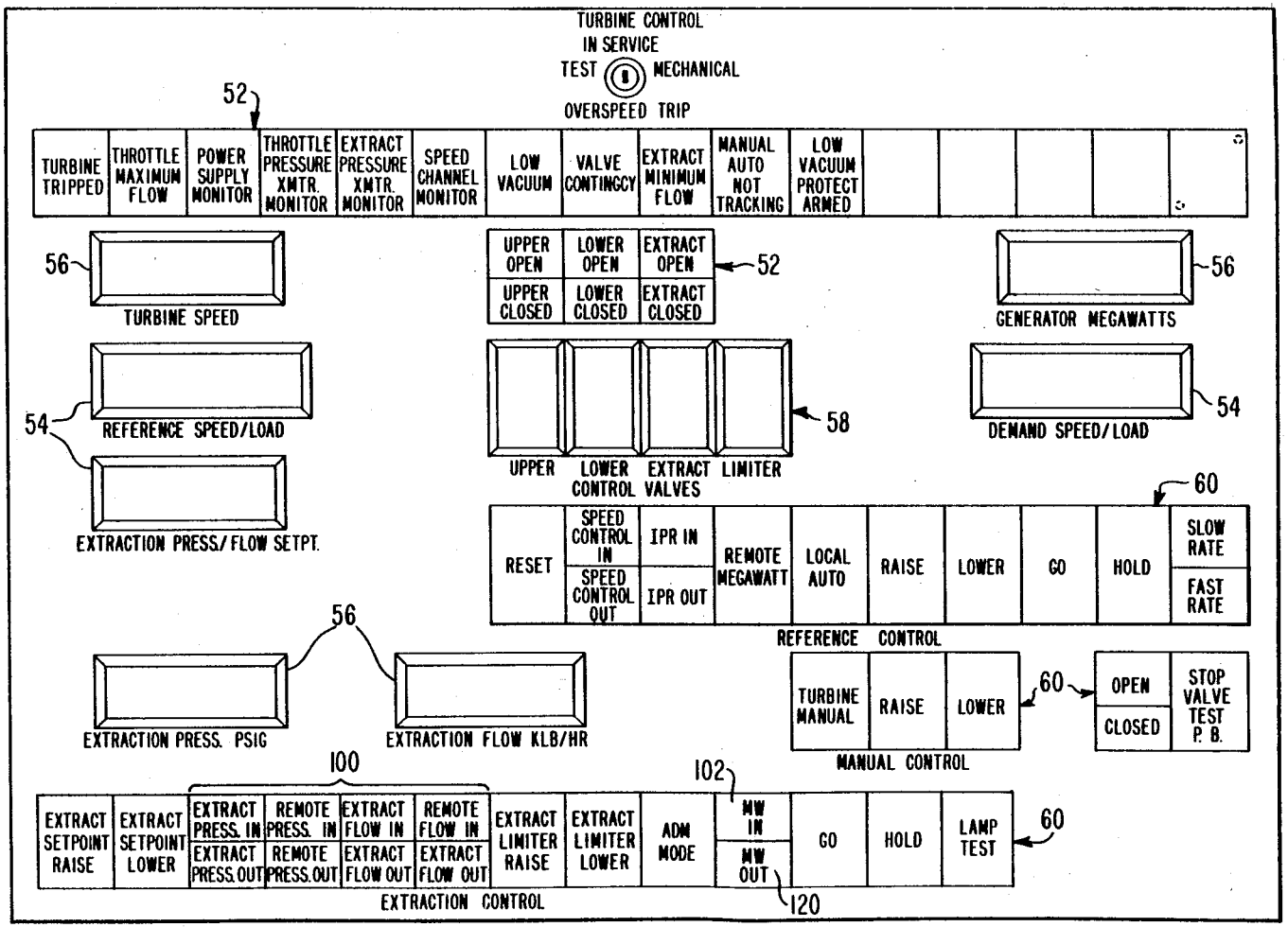
FIG. 2 shows a detail of the operator's panel portion of the present invention.

FIG. 2 shows the detail of the operator's panel 50 portion of the extraction turbine control system practiced in accordance with the present invention. The panel 50 includes an annunciator display 52 indicating system abnormalities, several digital readout displays, a group 54 indicating desired system operation levels and a group 56 indicating actual system operation levels, valve position panel meters 58, and a series of control pushbuttons 60 for megawatt control, extraction control and manual control. The control pushbuttons 60 allow the operator both to select the system operation mode and to establish the desired level of operation within the selected mode.

Figure 3:
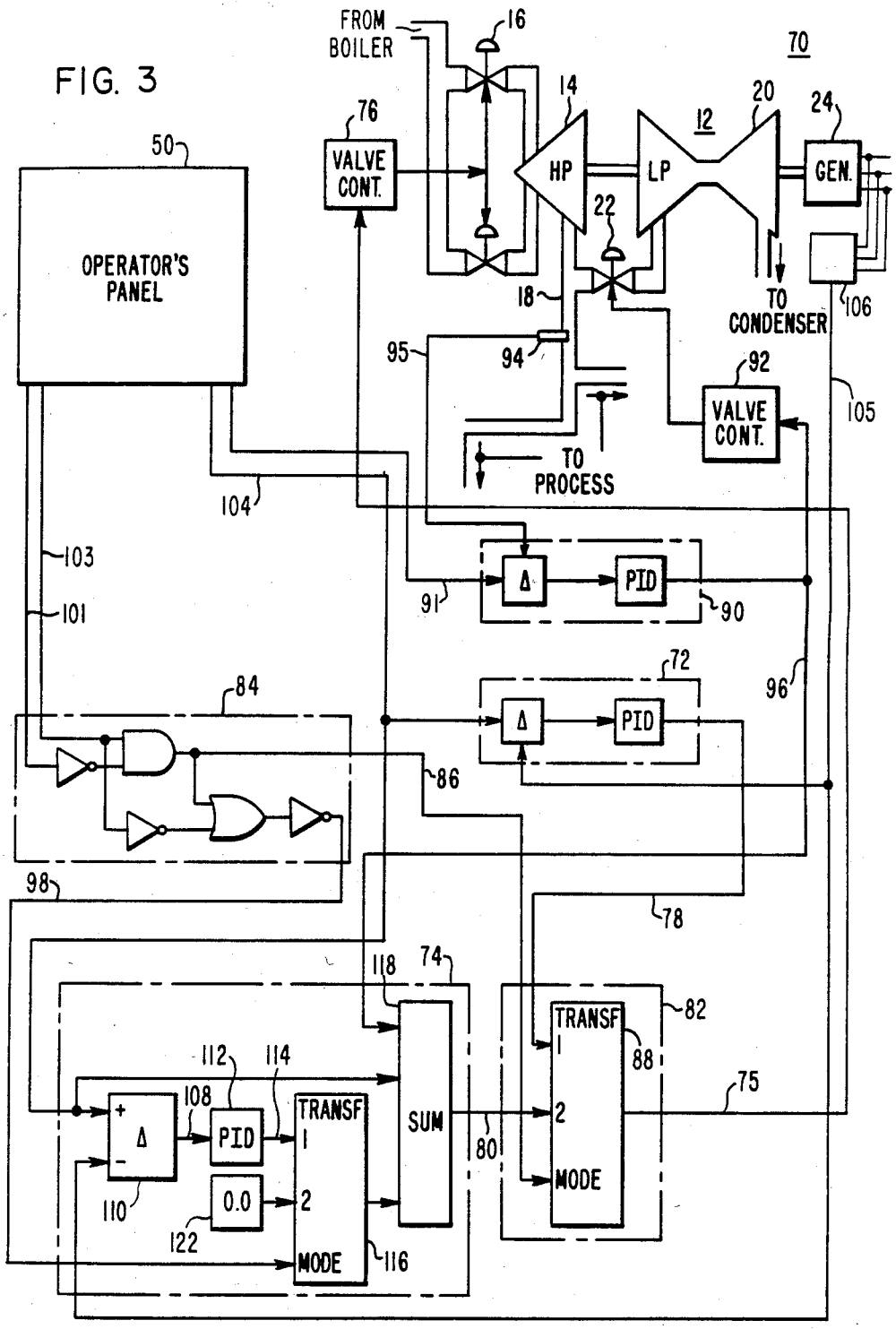
FIG. 3 shows an extraction turbine plant operated by a control system arranged in accordance with the principles of the invention.

FIG. 3 shows the preferred embodiment of the extraction turbine control system 70 practiced in accordance with the present invention. Two signal controllers 72 and 74 are provided to ultimately generate a control valve setpoint signal 75 to the valve controller 76 for positioning the extraction turbine control valves 16, a control valve setpoint signal controller 72 for use when the extraction control loop is out of service and the megawatt control loop is in service and a dual mode control valve setpoint signal correction controller 74 for use when both the extraction control and megawatt control loops are in service. In accordance with each of the several predetermined and distinct control strategies provided by the present invention, either the closed-loop control valve setpoint signal 78 or the correction mode-dependent control valve setpoint signal 80 is chosen to be used as the control valve setpoint signal 75. This choice is dependent upon the operational state of a second controller, the control valve setpoint signal selection controller 82.

The operational state of the control valve setpoint signal selection controller 82 is determined by a control mode selector 84. The control mode selector 84 generates a logic control signal 86 which determines the choice between the two available control valve setpoint signals 78 and 80 generated respectively by the two signal controllers 72 and 74. The control valve setpoint signal selection controller 82 uses this logic control signal 86 to determine which setpoint signal 78 or 80 will actually drive the valve controller 76 to the exclusion of the other available control valve setpoint signal. The signal controller 72 or 74 which generates the unused setpoint signal 78 or 80 operates in a conventional tracking mode, so as to provide bumpless transfer from one control strategy to another.

The control valve setpoint signal selection controller 82 employs a transfer functional control block 88. The transfer functional control block 88 has an algorithm for transfer of one or two analog inputs. Based on the logical state of a mode signal, the transfer functional control block 88 gates out one of the two analog input signals as the analog output signal. When the mode signal is in a "high" logical state, the signal on input one is gated out as the output signal. When the mode signal is in a "low" logical state, the signal on input two is gated out as the output signal. In this fashion, the control valve setpoint signal selection controller 82 implements the desired control strategy chosen by the operator via the operator's panel 50 and the control mode selector 84, as described further herein.

Control of the extraction valve 22 to regulate extraction steam flow or pressure is implemented through an independent controller, the extraction valve setpoint signal controller 90, which responds to the extraction reference signal 91. An extraction feedback control loop is employed, which includes the use of a valve controller 92, a steam pressure or flow sensor 94 and an extraction feedback signal 95. A signal element of the extraction control loop, the extraction valve setpoint signal 96, is used to correct the operation of one of the two megawatt control loops in accordance with a particular control strategy described further herein.

The control mode selector 84 generates two logic control signals 86 and 98 in response to pushbutton selections made at the operator's panel 50. The "megawatt loop in service and extraction loop out of service" (MWINEXTOUT) logic control signal 86 determines the operational state of the selection controller 82 and the "both loops in service" (BOTH LOOPS) logic control signal 98 determines the correction mode of the dual mode control valve setpoint signal correction controller 74, all in accordance with the predetermined control strategies herein described.

With reference to FIG. 3, the operation of the extraction turbine control system 70 is now described. Assume an extraction turbine operation in which little or no extraction steam is being taken from the extraction turbine 12, and the generator 24 is generating megawatts. As there is no extraction steam being taken, no extraction control loop has been selected in pushbutton group 100 on the operator's panel 60. Therefore, the "extraction loop in service" EXTIN logic control signal 101 is now in a "low" logical state. If the operator chooses to place a megawatt control loop in service at this time, selection of pushbutton 102 on the operator's panel 60 (see FIG. 2) causes the "the megawatt control loop in service" (MWIN) logic control signal 103 to go to a "high" logical state. The control mode selector 84 interprets both logic control signals 101 and 103 so as to cause the MWINEXTOUT logic control signal 86 to go to a "high" logical state. This establishes the first operational state. In this event, the transfer functional control block 88 of the control valve setpoint signal selection controller 82 transfers input one as its output, so that the control valve setpoint signal 75 is now equal to the closed-loop control valve setpoint signal 78 derived from the control valve setpoint signal controller 72 in a megawatt feedback control loop utilizing the megawatt output demand as represented by the megawatt reference signal 104 from the operator's panel 50, the megawatt feedback signal 105 from the megawatt transducer 106, and the valve controller 76.

As shown, the extraction reference signal 91 and the megawatt reference signal 104 are generated by the operator's panel. In the preferred embodiment, the extraction reference signal 91 and the megawatt reference signal 104 can be generated by a remote control system (not shown) which tracks the existing extraction steam level as represented by the extraction feedback signal 95 and the existing megawatt output as represented by the megawatt feedback signal 105 and generates an equivalent extraction reference signal and an equivalent megawatt reference signal, respectively, so as to achieve a bumpless transfer on a transition to the remote control mode. This same approach would be used to accomplish a bumpless transfer from the remote control mode back to the local control mode.

When the operator chooses to place the extraction control loop in service in addition to the megawatt control loop already in service, pushbutton selection of any of the several extraction control loop "in service" pushbuttons 100 on the operator's panel 50 (see FIG. 2) is interpreted by the control mode selector 84 so as to cause the logical state of the MWINEXTOUT logic control signal 86 to go to a "low" logical state while the BOTH LOOPS logic control signal 98 goes to a "high" logical state. This combination establishes the second operational state.

In this event, the BOTH LOOPS logic control signal 98 controls the correction mode of the dual mode control valve setpoint signal correction controller 74 so as to initiate generation of a correction mode-dependent control valve setpoint signal 80. Based on this same operator choice, the MWINEXTOUT logic control signal 86 sets the mode signal of the control valve setpoint signal selection controller 82 to a "low" logical state.

The control valve setpoint signal selection controller 82 then operates to select the correction mode-dependent control valve setpoint signal 80 from the two setpoint signals 78 and 80 available to it, so as to transfer the correction mode-dependent control valve setpoint signal 80 as the actual control valve setpoint signal 75 which is then fed to the valve controller 76. This operation of the control valve setpoint signal selection controller 82 establishes a second megawatt control loop, replacing the control valve setpoint controller 72 with the dual mode control valve setpoint signal correction controller 74. The second megawatt control loop provides tighter control of megawatt output during an extraction operation.

Generation of the correction mode-dependent control valve setpoint signal 80 in the dual mode control valve setpoint signal correction controller 74 is based upon three combinations of three signal inputs. The input signals are the extraction valve setpoint signal 96 from the extraction valve setpoint controller 90, the megawatt reference signal 104, from the operator's panel 50, and the megawatt feedback signal 105 from the megawatt transducer 106.

In operation, an increase in the demand for extraction steam affects the extraction turbine 12 by decreasing the steam flow to the low pressure portion 20 of the extraction turbine 12. A drop then occurs in the megawatt output of the extraction turbine 12, and the dual mode control valve setpoint signal correction controller 74 senses this in the first of its dual correction modes by comparison of the megawatt reference signal 104 with the megawatt feedback signal 105 to generate a megawatt error signal 108 which is the difference between these two signals and which is determined by the delta functional control block 110.

The megawatt error signal 108 is fed to a PID functional control block 112 which operates to generate a megawatt setpoint signal 114 based on a proportional plus integral plus derivative function of the megawatt error signal 108. The megawatt setpoint signal 114 is then fed to input one of the transfer functional control block 116 where it is gated out since the BOTH LOOPS logic control signal 98 has set the mode signal in a "high" logical state. The summer functional control block 118 sums the megawatt setpoint signal 114 with both the megawatt reference signal 104 and the extraction valve setpoint signal 96 so as to generate the correction mode-dependent control valve setpoint signal 80. The summer functional control block 118 algorithm produces an analog output which equals the sum of its three analog inputs, each of which has a gain term. The gain terms are used to weight the inputs differently with respect to each other.

As noted earlier, this is the particular control strategy in which the extraction valve setpoint signal 96 is used to correct the operation of one of the two provided megawatt control loops. In the above example, the increase in extraction steam demand is represented by an increase in the extraction valve setpoint signal 96 which is utilized in a feedforward fashion by the summer 118 of the dual correction mode control valve setpoint signal controller 74.

The combination of signals in the summer 118 results in tighter megawatt control because the control valve setpoint signal 75 is derived from the correction mode-dependent control valve setpoint signal 80 from the dual mode control valve setpoint signal correction controller 74. By using the extraction valve setpoint signal 96 as a feedforward signal in summer 118, the correction mode-dependent control valve setpoint signal 80 is extraction-corrected and begins corrective control of the steam turbine operation in anticipation of a power generation drop that would otherwise occur as a result of the increased extraction steam demand.

If the operator has chosen to operate the extraction turbine without utilizing the megawatt setpoint signal 114 as a trim signal, selection of the megawatt control loop "out of service" pushbutton 120 on the operator's panel 50 causes the MWIN logic control signal 103 to be in a "low" logical state, which will be interpreted by the control mode selector 84 so as to cause the MWINEXTOUT logic control signal 86 to be in a "low" logical state. The mode signal of the control valve setpoint signal selection controller 82 will also be in a "low" logical state, so that the correction mode-dependent control valve setpoint signal 80 will be selected as the control valve setpoint signal 75.

In this event, regardless of the status of the extraction control loop pushbuttons 100, the control mode selector 84 will also generate a BOTH LOOPS logic control signal 98 in a "low" logical state, which will set the mode signal on the transfer functional control block 116 so as to gate out input two as its output, which is a null input generated by the analog value generator functional control block 122.

In this second correction mode of the dual mode control valve setpoint signal correction controller 74, the megawatt setpoint signal 114 will not contribute to the summer functional control block 118, and one of two signal combinations are used in the summer functional control block 118, each combination corresponding to one of two correction submodes for generating the correction mode-dependent control valve setpoint signal 80 as its output. If the extraction valve setpoint signal controller 90 is operating because an extraction control loop has been selected, the megawatt reference signal 104 and the extraction valve setpoint signal 96 are used to generate the correction mode-dependent control valve setpoint signal 80 in an open-loop corrected fashion. Otherwise, with no extraction, only the megawatt reference signal 104 is used. In the latter case, the correction mode-dependent control valve setpoint signal 80 is really just an open-loop control valve setpoint signal and has no correction for the extraction operation, as there is none. Either of these cases provides open-loop control over megawatt output the distinction between them being whether there is or is not a feedforward contribution from the extraction valve setpoint signal 96, which depends on the operation of an extraction control loop. The accuracy of the megawatt output in either case will depend upon the calibration of the control valve cams, mechanical linkages, and position servo loop printed circuit cards. This calibration attempts to translate the value of the control valve setpoint signal 75 into the actual position of the control valves 16 without the benefit of a megawatt feedback error signal which would compensate for any inaccuracies in the calibration. However, if there is an extraction operation, the feedforward contribution of the extraction valve setpoint signal 96 still provides the control valves 16 with rough compensation for the extraction operation.

In the preferred embodiment, the turbine control system incorporates use of a single-board sixteen-bit microprocessor and an input and output interface having analog and digital conversion capability suitable for use in process environments, such as the MTCS—20 TM turbine control system, sold by the Westinghouse Electric Corporation. This microprocessor-based turbine control system has the inherent advantage of freedom from drift in calibration of components, along with ease of start-up and reduced maintenance requirements.

Figure 4:
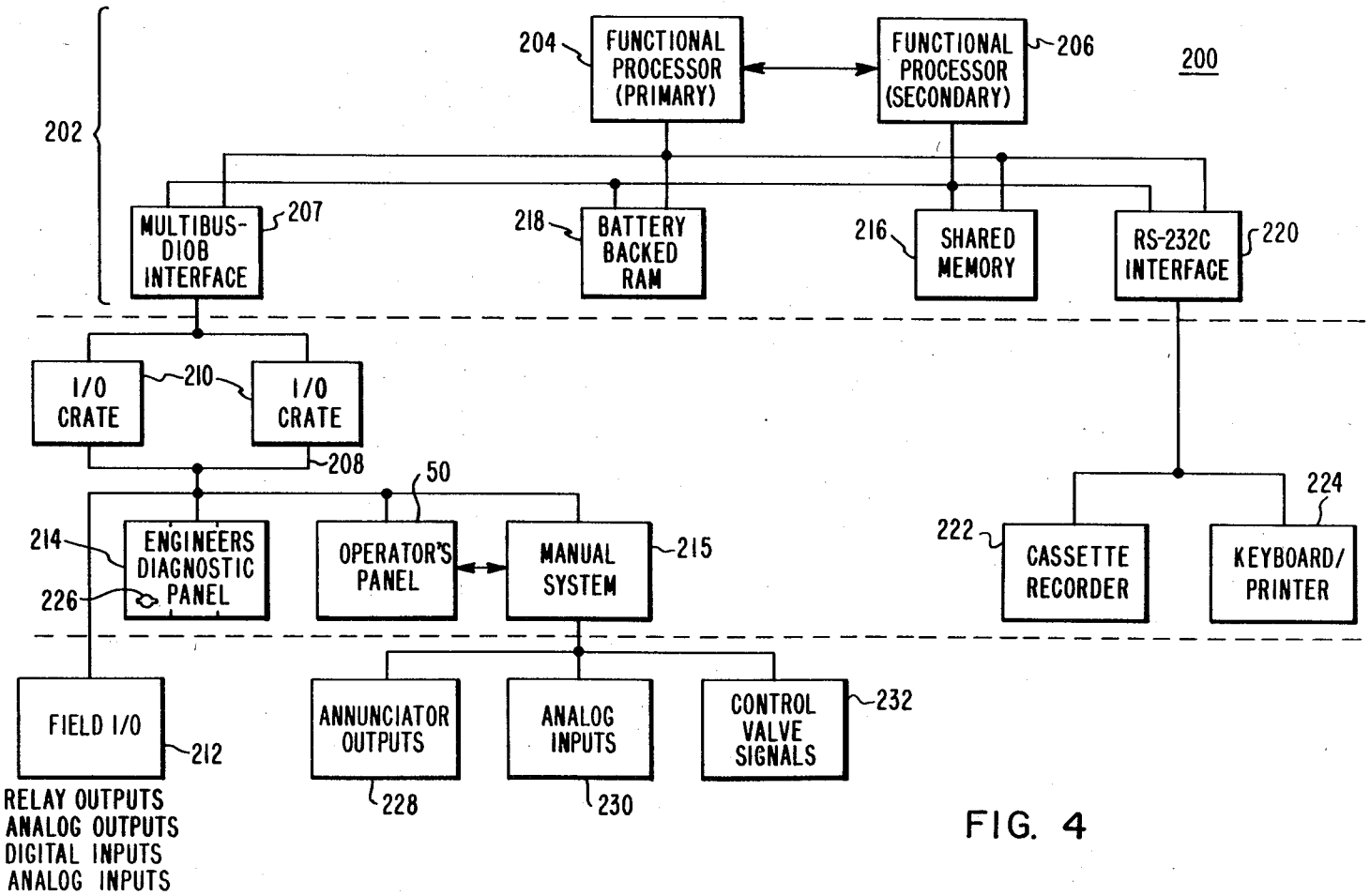
FIG. 4 shows a typical configuration of a microprocessor-based extraction turbine control system employed in the system of FIGS. 2 and 3.

A typical MTCS—20 TM turbine control system hardware configuration 200 is shown in FIG. 4. The MTCS—20 TM turbine control system uses a standard WDPF TM Multi-bus ® chassis configuration 202 with six printed circuit cards and with Westinghouse Q-line I/O, all of which is disclosed in a patent application bearing Ser. No. 508,951, filed June 29, 1983, assigned to the present assignee and incorporated herein by reference. The pertinent part of this application is the portion dealing with the "drop overview" as the MTCS—20 TM turbine control system is currently sold by Westinghouse as a stand-alone controller not connected to a data highway. ®Multibus is a registered trademark of Intel Corp. MTCS—20 TM and WDPF TM are trademarks of Westinghouse Electric /Corporation and Q-line is a series of printed circuit cards sold by Westinghouse Electric Corporation.

The dual functional processors 204 and 206 give the MTCS—20 TM turbine contorl system its first level of redundancy. The primary processor 204 is responsible for control loop execution while the normal function of the secondary processor 206 is tuning of the controller, listing the control loop, and displaying control parameters. If the primary processor 204 fails, the secondary processor 206 will automatically begin executing the control loop where the primary processor 204 left off. These two boards also contain duplicate sets of the algorithm library, which is described further herein.

The ®Multibus-DIOB interface card 207 gives the processors access to the I/O system. The Q-Line I/O bus 208 allows mixing of printed circuit point cards of any style anywhere on the bus 208. These cards are located in the I/O crates 210 and can be analog or digital, input or output, in any combination, and can accommodate a large variety of signal types. In the MTCS—20 TM turbine control system 200 these cards provide the interface to the field I/O signal group 212, the engineer's diagnostic panel 214, the operator's panel 50, and the manual system 215.

Two memory components of the MTCS—20 TM turbine control system 200 perform separate functions. A shared-memory board 216 is a 128K RAM board providing communication between the two functional processors 204 and 206. A battery-backed RAM board 218 is a 16K memory board on which the software application program for the control loops is stored. It retains its contents for up to 3 hours following a loss of power.

The last card in the ®Multibus chassis 202 is an RS—232C interface board 220 which interfaces a cassette recorder 222 used for permanent storage of the software application program for the control loops, and a keyboard/printer 224 used for entering, changing, and tuning the control loops.

The second level of redundancy in the MTCS—20 TM turbine control system 200 is an analog system, the manual system 215. It protects against failure of the digital system, in which case it would be automatically switched into operation to take control of the turbine. It also permits the plant operator to maintain control, while an engineer changes a digital control loop, by allowing the operator to manually position the turbine control and extraction valves 16 and 22 from the same operator's panel 50 used when the digital system is in control. It also constantly monitors the turbine speed and, in case of an overspeed condition, closes the turbine valves regardless of which system is in control.

The two I/O crates 210 can each hold up to 12 Westinghouse Q-Line I/O point cards. These cards are periodically polled by the software and all process information is retained in registers on the individual point cards. These registers appear as memory locations to the digital system which obtains data through memory accesses and outputs data by memory store commands (memory-mapped I/O). Thus the latest process information is always available to the system and the time response is not degraded by intermediate data handling or buffering.

Three point cards are dedicated to the engineer's diagnostic panel 214. This panel 214 consists of three modules that allow the engineer to monitor the status of the diagnostic alarms, control the mode of the digital system, and display the output of any two system signals. The mode control module in the engineer's diagnostic panel 214 permits an engineer to load a control program, tune algorithms in the loop, or display parameters on the display module. The mode control module provides security from unauthorized used by a two-position keylock switch 226.

The field I/O signal group 212 is made up of the I/O signals from the field I/O hardware which includes field instrumentation such as sensors or transducers 94 and 106 in FIG. 3, and field actuators that are located on the extraction turbine and the associated steam flow piping. The annunciator output signal grouping 228 indicates system abnormalities and is typically tied to multiple annunciator display panels in the control room or elsewhere. The analog input signal grouping 228 is segregated and tied directly to the manual system 215 so that in the event of a loss of the digital control system, essential signals for manual control are available. The control valve signal grouping 232 includes the valve servo position loop signals to and from the servo actuators which tie into the valve controllers 76 and 92 (see FIG. 3).

The software application programs for the control loops of FIG. 3 are furnished in the MTCS—20 TM microprocessor in the form of software application program algorithms based on the use of modular functional control blocks. The functional control blocks are designed to replace tasks which a typical analog or digital control loop needs to perform. The set of available functional control blocks forms the algorithm library and includes arithmetic blocks, limit blocks, control blocks, I/O blocks, auto/manual blocks, (for manual setpoint entry and control), and miscellaneous blocks. The miscellaneous category includes functions for generating analog and digital values, generating polynomial functions, gating one of two analog signals based on the logic state of a mode signal, time delays, etc.

The MTCS—20 TM turbine control system is designed for interactive entry of functional control blocks on a line-by-line basis, to form the application program. Each line of the application program consists of the functional control block number, the algorithm name (from the algorithm library) corresponding to that functional control block, and each of the parameter locations forming the arguments or inputs to that algorithm. Each functional control block chosen by the operator and listed on a line of the application program is task-specific, with only one output, which provides a high degree of flexibility and ease of changing. A translator handles the functional control blocks in the order in which they were entered by the operator. It translates the algorithm name of the functional control block, which the operator understands, into a series of data blocks in the pre-specified operator-chosen order so that each data block has a block number, algorithm number, parameter location, parameter location, parameter location, etc. for as many parameters as that particular algorithm requires. The translator also checks the syntax of the operator-entered data, and thereby preprocesses the application program for block-sequential, run-time interpretation by an interpreter. The interpreter executes the application program in the functional processor and works on the series of data blocks which the translator has created. The interpreter calls the algorithms in the order in which they were entered, corresponding to the lines of the application program. The interpreter also routes the answers generated by each algorithm to the correct location in memory for use by later blocks in the application program. The use of a run-time interpreter eliminates compiling, thereby saving time and increasing the flexibility and ease of programming. The completion cycle time of the control loop is user-selectable.

We claim:

1. A control apparatus for operating an extraction steam turbine-electric power generation system to satisfy extraction steam and megawatt output demand, said apparatus comprising:

at least one turbine inlet steam control valve;

a turbine extraction valve;

a first valve controller means for positioning said control valve;

a second valve controller means for positioning said extraction valve;

a megawatt output transducer means for generating a megawatt feedback signal corresponding to the existing level of megawatt output;

a sensor means for generating an extraction feedback signal corresponding to the existing level of extraction steam;

a control mode selector means for determining a first operational state corresponding to the presence of said megawatt output demand and the absence of said extraction steam demand and a second operational state corresponding to the presence of both said megawatt output demand and said extraction steam demand;

an operator panel means for generating at least one signal to determine the operation of said control mode selector means in accordance with an operator selection at said operator panel means;

a control valve setpoint signal selection controller means for selecting a first control valve setpoint signal in said first operational state or a second control valve setpoint signal in said second operational state and establishing said selected control valve setpoint signal operative with said first valve controller means;

a control valve setpoint signal controller means for determining said first control valve setpoint signal in accordance with said megawatt output demand and said megawatt feedback signal, said first control valve setpoint signal connected to said control valve setpoint signal selection controller means;

an extraction valve setpoint signal controller means for determining an extraction valve setpoint signal in accordance with said extraction steam demand and said extraction feedback signal, said extraction valve setpoint signal operative with said second valve controller means; and a control valve setpoint signal correction controller means for determining said second control valve setpoint signal in accordance with a predetermined function of said megawatt feedback signal, said megawatt output demand, and said extraction valve setpoint signal, said second control valve setpoint signal connected to said control valve setpoint signal selection controller means.

2. The control apparatus of claim 1, wherein said predetermined function of said control valve setpoint signal correction controller means is the sum of the value of said extraction valve setpoint signal, the value of said megawatt output demand, and the value of a proportional plus integral plus derivative function of the difference between the value of said megawatt output demand and the value of said megawatt feedback signal.

3. The control apparatus of claim 1, wherein said control valve setpoint signal controller means tracks the value of said second control valve setpoint signal and said control valve setpoint signal correction controller means tracks the value of said first control valve setpoint signal so as to provide a bumpless transfer when said control valve setpoint signal selection controller means establishes said selected control valve setpoint signal during a change from one of said operational states to another.

4. A control apparatus for operating an extraction steam turbine-electric power generation system to satisfy extraction steam and megawatt output demand by adjusting at least one inlet steam control valve and an extraction valve, said apparatus comprising:

a control mode selector means for determining a first operational state corresponding to the presence of said megawatt output demand and the absence of said extraction steam demand and a second operational state corresponding to the presence of both said megawatt output demand and said extraction steam demand;

an operator panel means for generating a signal to determine the operation of said control mode selector means in accordance with a selection made by an operator at said operator panel means;

a control valve setpoint signal selection controller means for selecting a first control valve setpoint signal in said first operational state or a second control valve setpoint signal in said second operational state and establishing said selected control valve setpoint signal operative with said inlet steam control valve;

a control valve setpoint signal controller means for determining said first control valve setpoint signal in accordance with said megawatt output demand and the existing megawatt output level in said system, said first control valve setpoint signal connected to said control valve setpoint signal selection controller means;

an extraction valve setpoint signal controller means for determining an extraction valve setpoint signal in accordance with said extraction steam demand and the existing extraction steam level in said system, said extraction valve setpoint signal operative with said extraction valve; and a control valve setpoint signal correction controller means for determining said second control valve setpoint signal in accordance with a predetermined function of said existing megawatt output level, said megawatt output demand and said extraction valve setpoint signal, said second control valve setpoint signal connected to said control valve setpoint signal selection controller means.

5. The control apparatus of claim 4, wherein said predetermined function of said control valve setpoint signal correction controller means is the sum of the value of said extraction valve setpoint signal, the value of said megawatt output demand, and the value of a proportional plus integral plus derivative function of the difference between the value of said megawatt output demand and the value of said existing megawatt output level in said system.

6. The control apparatus of claim 4, wherein said control valve setpoint signal controller means tracks the value of said second control valve setpoint signal and said control valve setpoint signal correction controller means tracks the value of said first control valve setpoint signal so as to provide a bumpless transfer when said control valve setpoint signal selection controller means establishes said selected control valve setpoint signal during a change from one of said operational states to another.

7. The control apparatus of claim 4, wherein said second operational state is inoperable unless said existing megawatt output level is above approximately 20% of the rated load of said system.

8. The control apparatus of claim 4, further comprising a remote control means which tracks the existing level of said extraction steam and the existing level of said megawatt output and generates an equivalent remote extraction reference signal and an equivalent remote megawatt reference signal, respectively, said remote extraction reference signal coupled to said extraction valve setpoint signal controller means through a first bumpless transfer means for switching from said extraction steam demand to said remote extraction reference signal in a bumpless manner, and said remote megawatt reference signal coupled to both said control valve setpoint signal controller means and said control valve setpoint signal correction controller means through a second bumpless transfer means for switching from said megawatt output demand to said remote megawatt reference signal in a bumpless manner.

9. The control apparatus of claim 4, wherein a digital computer means and an input and output interface means having analog and digital conversion capability suitable for use in process environments are employed to provide said control mode selector means, said control valve setpoint signal selection controller means, said control valve setpoint signal controller means, said extraction valve setpoint signal controller means, and said control valve setpoint signal correction controller means.

10. The control apparatus of claim 9, wherein said digital computer is programmed to provide a set of modular functional control blocks which are employed to form said control mode selector means, said control valve setpoint signal selection controller means, said control valve setpoint signal controller means, said extraction valve setpoint signal controller means, and said control valve setpoint signal correction controller means.

11. The control apparatus of claim 10, wherein the names of said modular functional control blocks are entered into said digital computer means in an interactive fashion.

12. The control apparatus of claim 11, wherein a translator means handles said functional control blocks in accordance with the sequence of entry into said digital computer means to form a software application program, each line of said software application program corresponding to one modular functional control block.

13. The control apparatus of claim 12, wherein an interpreter means is employed to execute said software application program in said digital computer means on a line-by-line basis in accordance with the lines of the software application program.

14. A method of operating an extraction steam turbine-electric power generation system to satisfy extraction steam and megawatt output demand by adjusting at least one inlet steam control valve and an extraction valve, said method comprising the steps of:

determining a first or a second operational state, said first operational state corresponding to the presence of said megawatt output demand and the absence of said extraction steam demand, said second operational state corresponding to the presence of both said megawatt output demand and said extraction steam demand;

determining, if in said first operational state, a first control valve setpoint signal in accordance with said megawatt output demand and the existing megawatt output level in said system and operating said inlet steam control valve in accordance with said first control valve setpoint signal;

determining, if in said second operational state:

(a) an extraction valve setpoint signal in accordance with said extraction steam demand and the existing extraction steam level in said system, (b) a second control valve setpoint signal in accordance with a predetermined function of said megawatt output demand, said existing megawatt output level and said extraction valve setpoint signal, (c) operating said extraction valve in accordance with said extraction valve setpoint signal, and (d) operating said inlet steam control valve in accordance with said second control valve setpoint signal.

15. The method of claim 14, with the substep for determining said second control valve setpoint signal in accordance with a predetermined function further comprising:

determining the value of the difference between said megawatt output demand and said existing megawatt output level, determining the value of a proportional plus integral plus derivative function of said difference value, summing the value of said extraction valve setpoint signal with the value of said megawatt output demand and the value of said function of said difference value, and establishing said sum as the value of said second control valve setpoint signal.

* * * * *